US007967153B2

(12) United States Patent
Simhaee

(10) Patent No.: US 7,967,153 B2
(45) Date of Patent: Jun. 28, 2011

(54) COMPACT MULTI-RACK T-SHIRT BAG CAROUSEL

(76) Inventor: Ebrahim Simhaee, Los Angeles, CA (US)

( * ) Notice: Subject to any disclaimer, the term of this patent is extended or adjusted under 35 U.S.C. 154(b) by 106 days.

(21) Appl. No.: 12/337,130

(22) Filed: Dec. 17, 2008

(65) Prior Publication Data

US 2010/0148019 A1 Jun. 17, 2010

(51) Int. Cl.
*A47G 29/00* (2006.01)

(52) U.S. Cl. ..... 211/85.15; 211/163; 211/181.1

(58) Field of Classification Search ..... 211/50, 211/59.1, 163, 85.15, 181.1; 248/95, 97, 248/99, 100, 153, 175
See application file for complete search history.

(56) References Cited

U.S. PATENT DOCUMENTS

| | | | | |
|---|---|---|---|---|
| 363,172 | A * | 5/1887 | Saurer | 248/97 |
| 1,524,300 | A * | 1/1925 | Gottlieb | 211/163 |
| 1,580,163 | A * | 4/1926 | Peterson et al. | 248/97 |
| 3,642,145 | A * | 2/1972 | Shelton | 211/78 |
| 4,576,350 | A * | 3/1986 | Bond | 248/97 |
| 5,033,703 | A * | 7/1991 | Allen, Sr. | 248/97 |
| 5,125,604 | A * | 6/1992 | Vrooman et al. | 248/97 |
| 5,131,499 | A * | 7/1992 | Hoar | 186/66 |
| 6,550,583 | B1 * | 4/2003 | Brenhouse | 186/66 |
| 7,516,820 | B1 * | 4/2009 | Cox et al. | 186/66 |
| 2007/0186515 | A1 * | 8/2007 | Ruetten et al. | 53/502 |

* cited by examiner

*Primary Examiner* — Korie Chan
(74) *Attorney, Agent, or Firm* — Leason Ellis LLP

(57) ABSTRACT

A compact multi-unit carousel of the present invention contains multiple t-shirt bag racks in which the arms for holding the handles of the T-shirt are parallel to one another and supported by extensions that are radially approximately 120 degrees from each other.

14 Claims, 13 Drawing Sheets

COMPACT MULTI-RACK T-SHIRT BAG CAROUSEL

TECHNICAL FIELD

The present invention relates generally to a compact multi-unit carousel rack that may hold a bundle of T-shirt bags so as to permit a user to more easily reach and load multiple bags.

BACKGROUND OF THE INVENTION

Plastic grocery bags are light, sturdy and easy to carry because of built-in handles. They also have the added advantage of preventing foods from leaking should an accident occur while enroute from a store to the home. Plastic bags are used extensively in supermarkets, grocery stores and other stores selling multiple household items. A typical type of plastic bag used in such stores is known as a T-shirt bag, an example of which shown in FIG. 1. These bags come bundled together and are designed to be used on a bag holder. One example of such a current holder is a rectangular cubic rack (FIG. 2), which is used not only to hold a bundle of T-shirt bags, but also permits the leading bag to stay open while a bagger or cashier puts the merchandise inside the bag.

Most of the time customers buy more than the capacity of one bag. As a result there is a need for two or more bags. In addition, sometimes customers buy different items that cannot be next to each other in one bag. For example, items such as Clorox, bar soap or laundry detergent should not be placed in one bag next to food items such as fresh meat, fish or deli items. In other words, each category of items should be packed in its own bag.

While bagging groceries, sometimes there is only one rack available per user. This limitation of rack availability increases the usage of T-shirt bags because, if there is a need for separation, the user has to pull the T-shirt bag out of the rack prematurely before the bag is filled and start a new bag to separate different merchandise. To overcome this problem, some stores use two rectangular cubic racks side by side or next to each other, while other stores use multi-unit carousel racks that have three or more rectangular cubic racks on top of a circular board or base. The carousel racks can easily turn to the left or to the right along with their base. These multi-unit carousel racks have some advantages compared to two side by side racks, such as giving more than one choice to the user in separating items. As a result, the user can use more of the capacity of the bags before the bags are removed from the racks. Another advantage of multi-unit carousel racks is that the speed of bagging groceries by the cashier is increased and less baggers are required which cuts back on the required man power.

However, there are disadvantages of current multi-unit carousel racks. The cubic rectangular racks on a carousel base are far from each other and the cashier does not have easy access to more than two racks. As a result, for the cashier to put additional items into a third bag, their work (scanning new items) stops since they have to turn the carousel either to the right or to the left. Alternatively, the cashier will need to take extra steps to the left or right to put the next item inside the third bag. In addition, the diameter of the circular base of the carousel racks are large and some stores, especially the smaller ones, do not have the space for these big carousel racks at their front end tables next to the cashier.

It is with these considerations that the present invention is contemplated.

DETAILED DESCRIPTION OF THE INVENTION

Certain embodiments of the invention are described more specifically with reference to the accompanying drawings. The invention may be embodied in many different forms and should not be construed as limited to the embodiments described herein. Rather, the embodiments may take different forms. Throughout this description, the various embodiments are not intended to be limiting unless so specified. References to one embodiment or another embodiment are intended to be interchangeable such that aspects of different embodiments may be combined in various ways to implement the disclosed invention.

In one embodiment of the invention, a multi-unit carousel contains three racks in which each of the racks has a reduced area, defining a partial hexagon area above the base, that results in a compact design.

In another embodiment of the invention, the partial hexagon-shaped racks of the multi-unit carousel are mounted on a rotating base with cutout sections so as to reduce the distance that a user must reach to place items within the most distant bag when the rack is loaded with T-shirt bags.

In another embodiment of the system, the partial hexagon-shaped racks of the multi-unit carousel are formed from a central support from which extend three extensions in a radial direction, with each extension having two arms. Each rack is formed such that a bundle of T-shirt bags may be hung adjacent the central support between each extension by tabs on the T-shirt bags and the arms attached to adjacent extensions extend through each of the handles of the T-shirt bags, such that a bag may be detached from the bundle and held in the open position by each of the compact racks.

Figure 1:
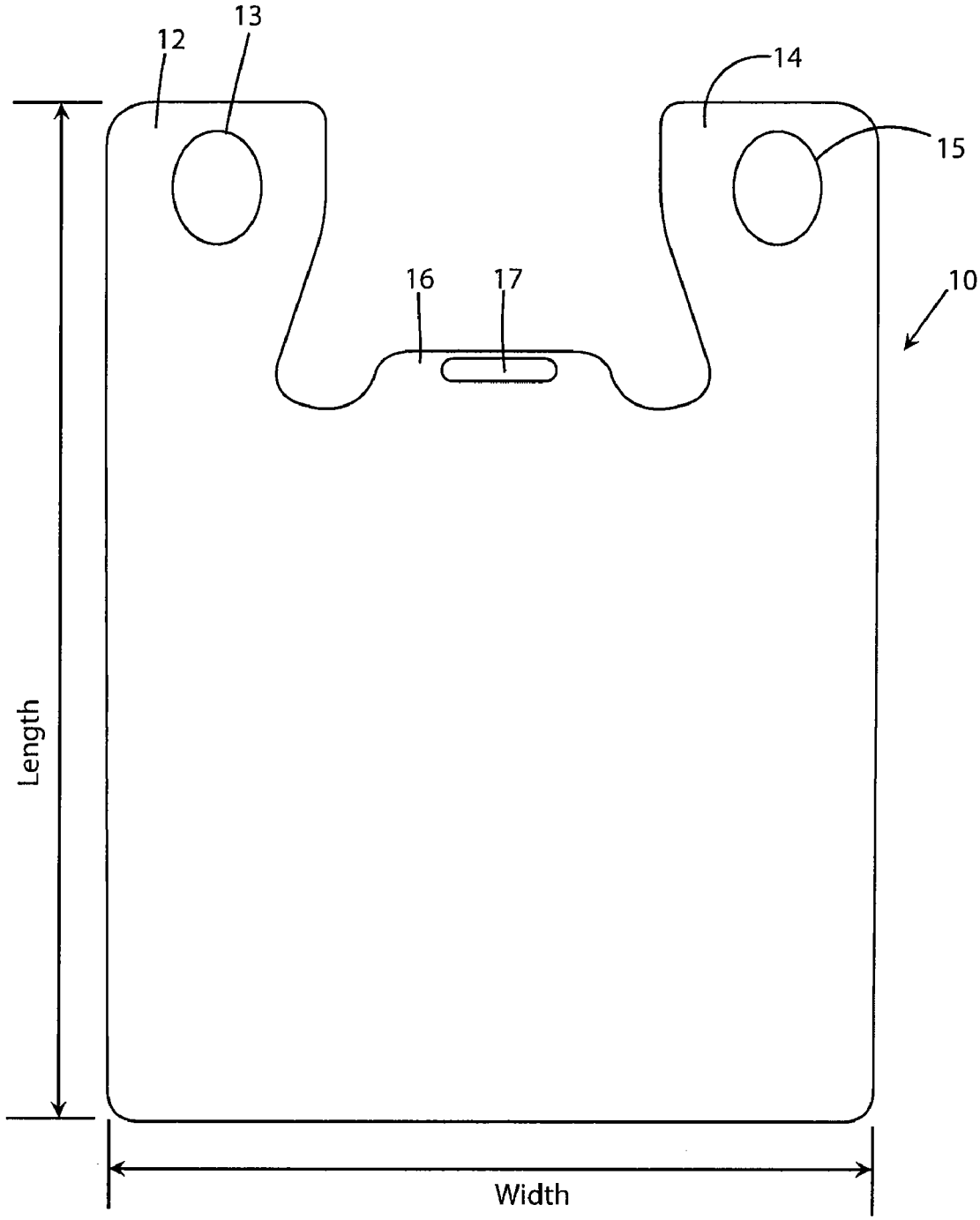
FIG. 1 is an example of a current plastic T-shirt bag.
Figure 2:
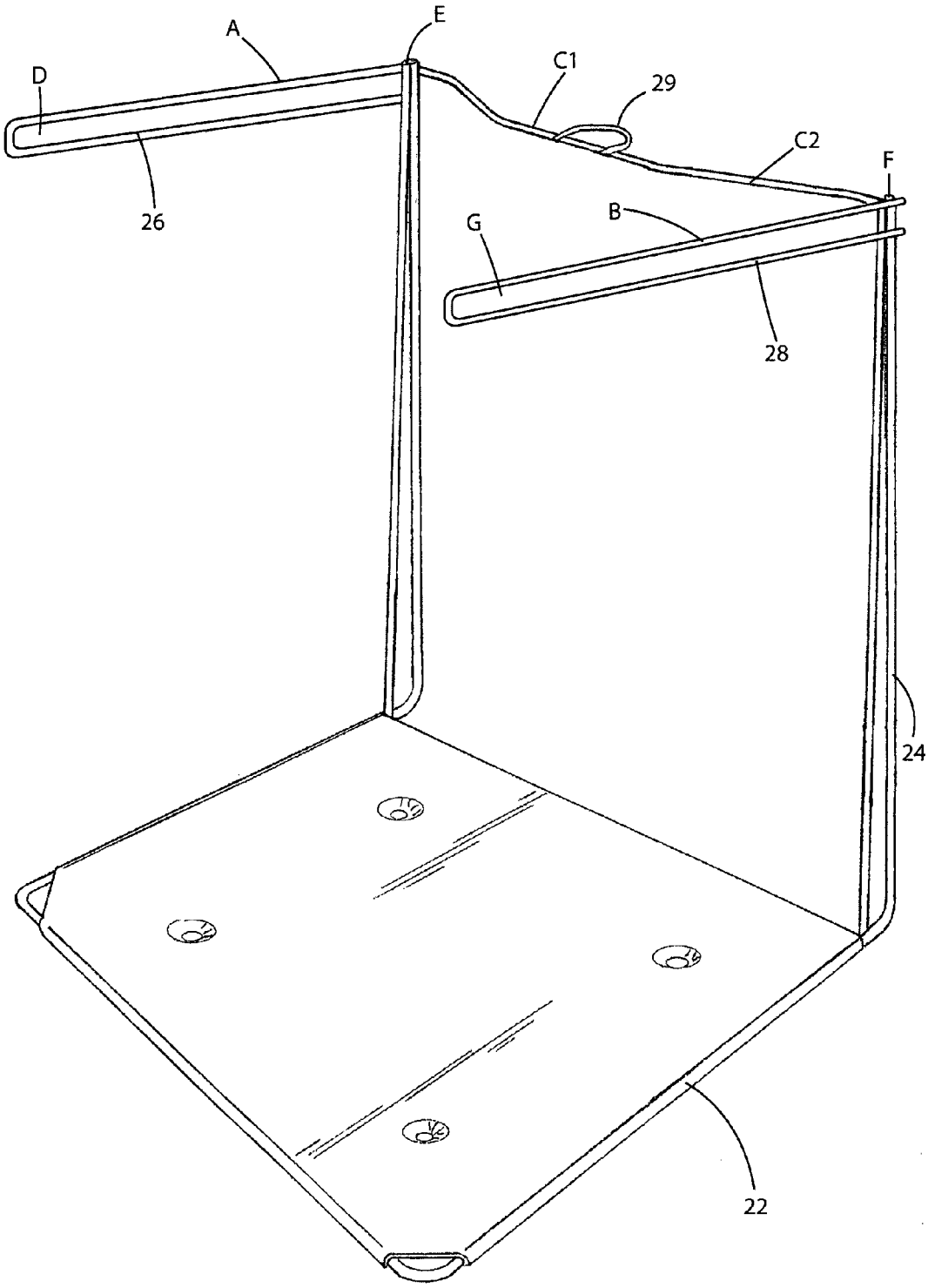
FIG. 2 (PRIOR ART)
FIG. 2 is a prior art single cube rack.

A typical T-shirt bag is shown in FIG. 1. The size of an ordinary T-shirt bag is about 12" by 7" by 20" up to about 12" by 7" by 24". Usually, the width (12") and the depth (7") does not change. However, to increase the capacity of the T-shirt bag, the length of the bag varies from 20" to 24". At a typical checkout counter, a series of T-shirt bags may be held in a T-shirt rack for the convenience of the cashier or bagger. Currently, T-shirt racks are designed as a cube to accommodate an ordinary T-shirt bag as shown in FIG. 2. The prior art cube T-shirt racks comprise a base 22, vertical support member 24, arms 26 and 28, and projection 29. The distance between arms 26 and 28 is typically about 12" (about the width of the bag) and the length of the arms 26 and 28 are typically about 8" (about 1" more than the depth or gusset of the bag). The height of arms 26 and 28 from the base 22 depends on the length of the bag, and changes approximately from 11" to 15".

A cube rack is loaded with a bundle of T-shirt bags by threading arms 26 and 28 of the rack through handle holes 13 and 15 (FIG. 1) of the handles 12 and 14 of the bags. Usually, when loaded with bags, the two handles 12 and 14 of the T-shirt bags are pushed all the way back toward the end of the arms 26 and 28, closest to vertical support 24. The bundle of bags may be supported on projection 29 of the cube rack by tab 16 through tab slot 17. When the user pulls and opens the leading bag, the position of front panel of the opened leading bag will be near the front of the rack and the back panel of the T-shirt bag is still hung on projection 29 by tab 16. As a result, the back panel continues to stay on the back of the rack. Usually the handle holes 13 and 15 (FIG. 1) of a T-shirt bag are located about 2.5 inches under the top edges of handles 12 and 14. In a fully opened and loaded bag, the two front layers of each handle (each handle of a T-shirt bag usually consists of four layers) is positioned near the front of the arms (points D and G of arms 26 and 28, FIG. 2) and the two back layers of the handles are usually positioned at points A and B, which are typically less than 5" away from the points D and G and more than 3" from points E and F. The maximum distance between the hole of the front two layers of the handle and the hole of the back two layers of the handle when the front and back layers are stretched away from each other is approximately 5 inches.

Figure 3:
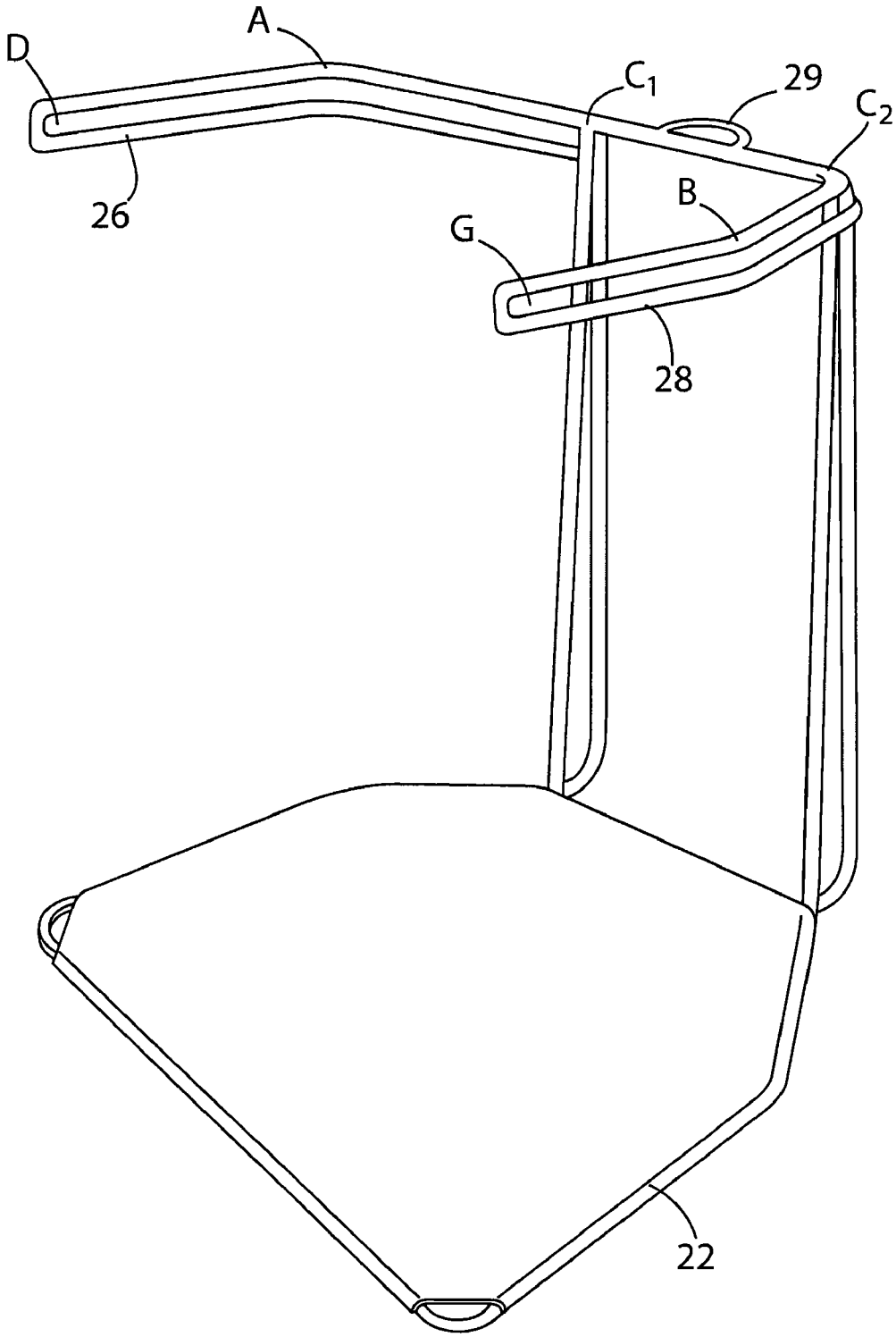
FIG. 3 is a perspective view of one unit of a multi-unit carousel rack of the present invention.

As a result, when a bundle of bags is loaded on a rack, there is no difference in the opening or performance of the lead bag if the handles of the lead bag have been pushed all the way to the points E and F during loading (FIG. 2), or stopped at points A and B. As a result the area defined by A to E to C1 and the area defined by B to F to C2 is not generally useful. If these areas are eliminated as shown in one embodiment of the present invention in FIG. 3, the performance of the rack in holding a bundle of bags and maximum opening of the leading bag does not change.

Figure 4:
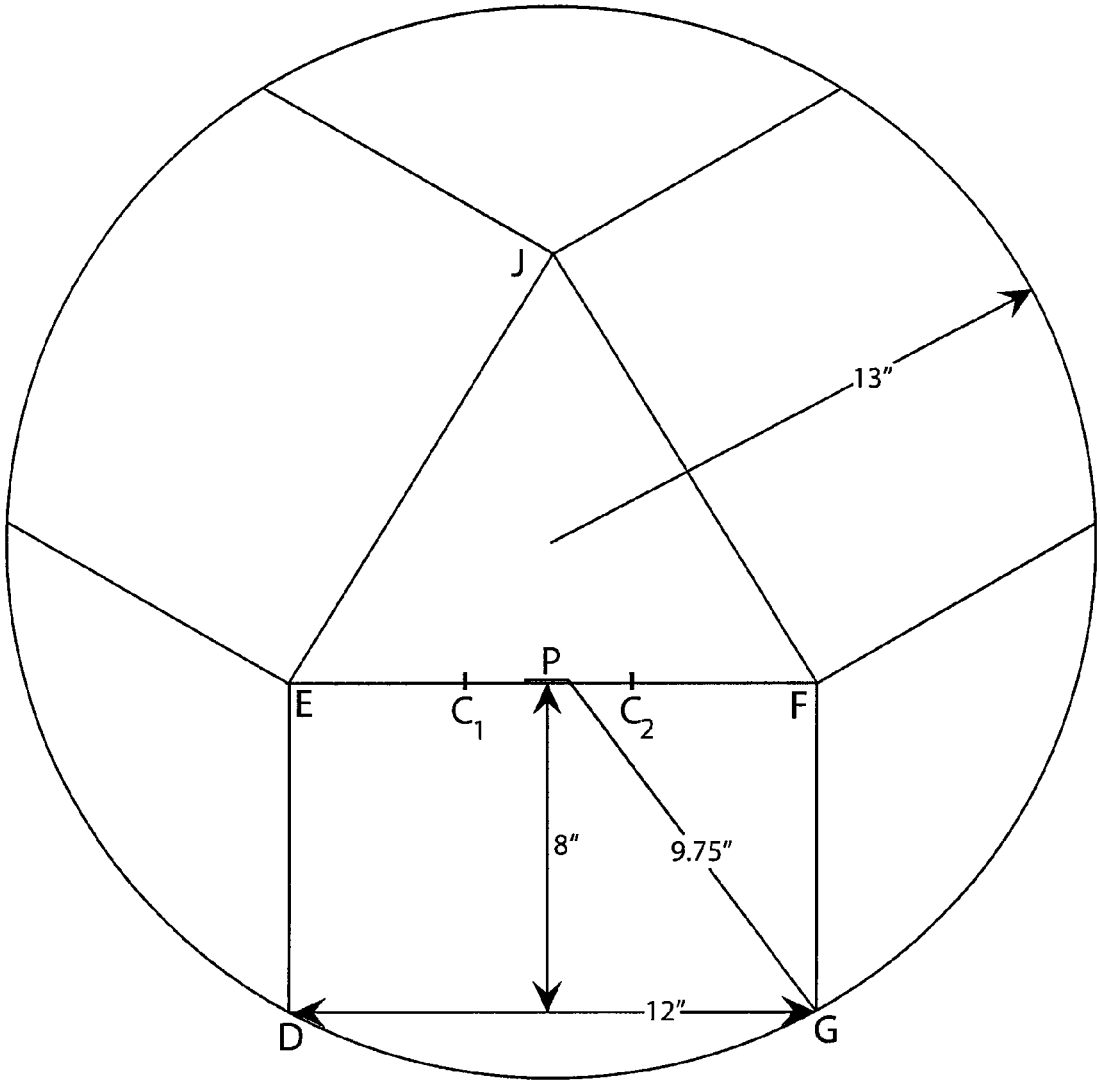
FIG. 4 (PRIOR ART)
FIG. 4 is a schematic top view of a multi-unit carousel rack of the prior art.

The current prior art cube racks may be placed on a carousel. The carousel consists of a circular base, which easily turns toward the left or right, with three or more rectangular cubic racks similar to that of FIG. 2 installed on the top of it. In each rack, the distance between two arms at the front, middle or back of the rack is 12" and the length of the arms are 8" as shown schematically in FIG. 4. As a result, the distance between projection P and an imaginary line which connects points D and G is 8". The distance between projection P to the tip of each arm is about 9.75". The circular board which the three racks are installed on top of it has a radius of 13", The area between the three racks on the carousel is an unused equilateral triangle space and each side of triangle has 12" length and its surface is about 62.35 square inches.

Figure 5:
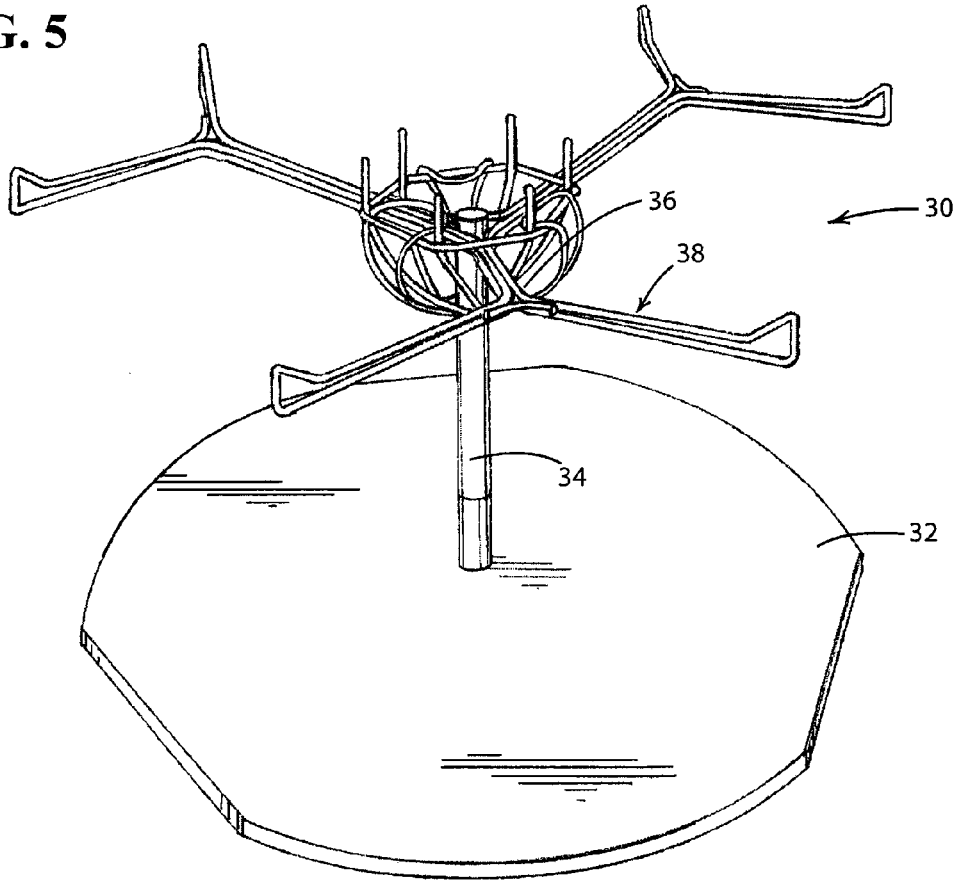
FIG. 5 is a top perspective view of a multi-unit carousel rack of the present invention.
Figure 7:
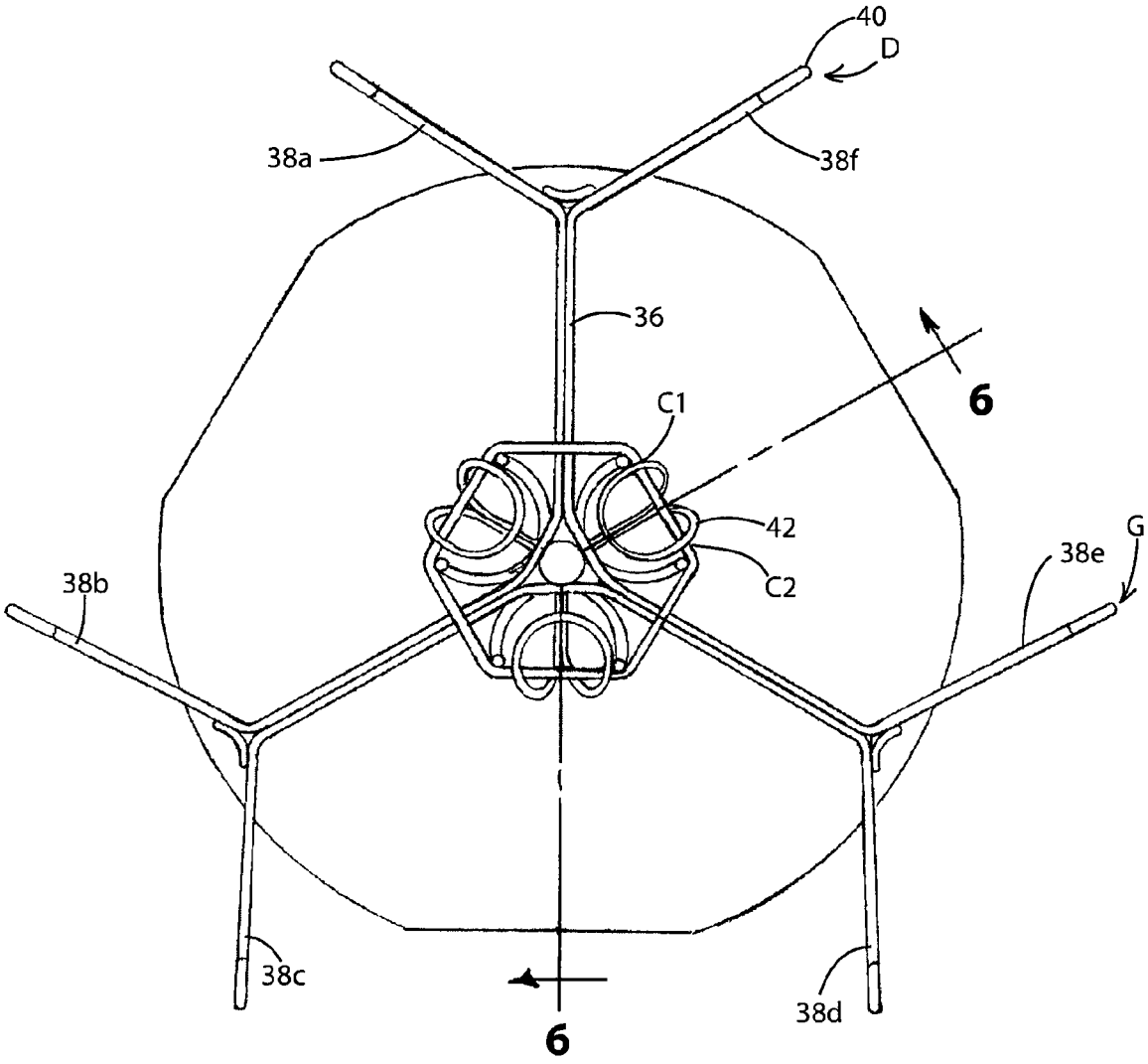
FIG. 7 is a top view of the multi-unit carousel rack of the present invention.

FIG. 5 shows a carousel rack with the three new innovative compact racks installed on it. The carousel rack of the present invention contains a base 32 connected to a vertical support 34. At the top of vertical support 34 are extensions 36. In this embodiment, there are three extensions. Extensions 36 extend from and are perpendicular to the longitudinal axis of vertical support 34 and are equidistant around the circumference of vertical support 34. At the end of each extension 36 are a pair of arms 38. Thus, in this embodiment, there are six arms 38, which are labeled as 38*a* through 38*f* in FIG. 7. Although in this embodiment the structures are shown as rods or bars, any structure capable of holding T-shirt bags may be used. As one alternative example, instead of vertical support 34, three vertical supports may be used at the location that the arms connect with the extensions. In another example, a vertical board may replace the extensions and connect directly to base 32 so that they would function both as a vertical support and extension to hold arms 38. This would provide additional segmentation between the bag holders. Any other supporting structure for the arms may be used as long as the volume between the base, arms and supporting structure defines an area in which unused space between the racks on a carousel is minimized.

Figure 6:
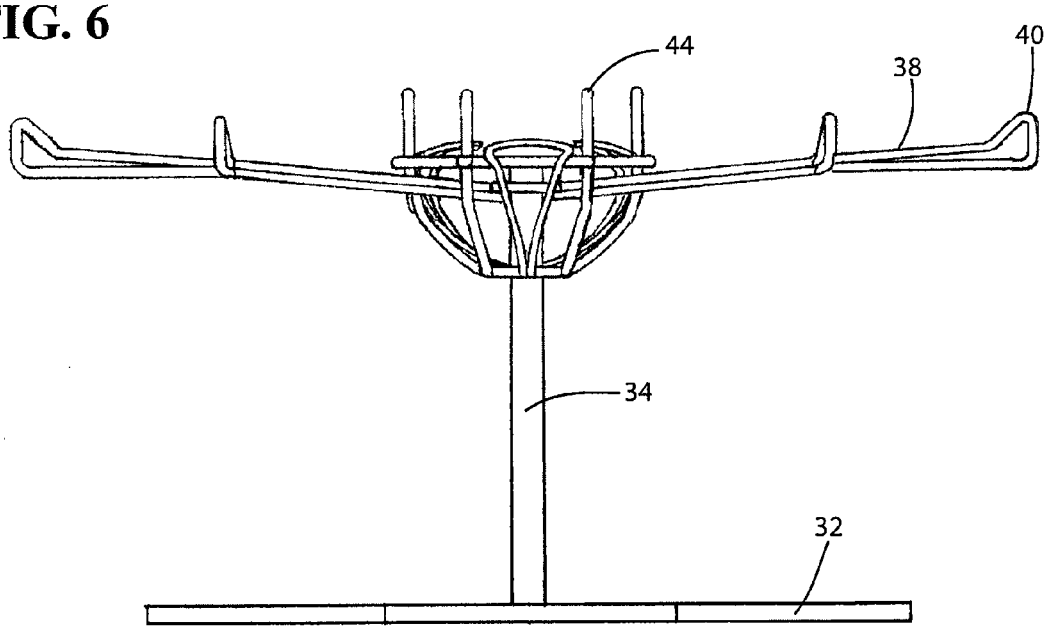
FIG. 6 is a side view of the multi-unit carousel rack of the present invention.
Figure 8:
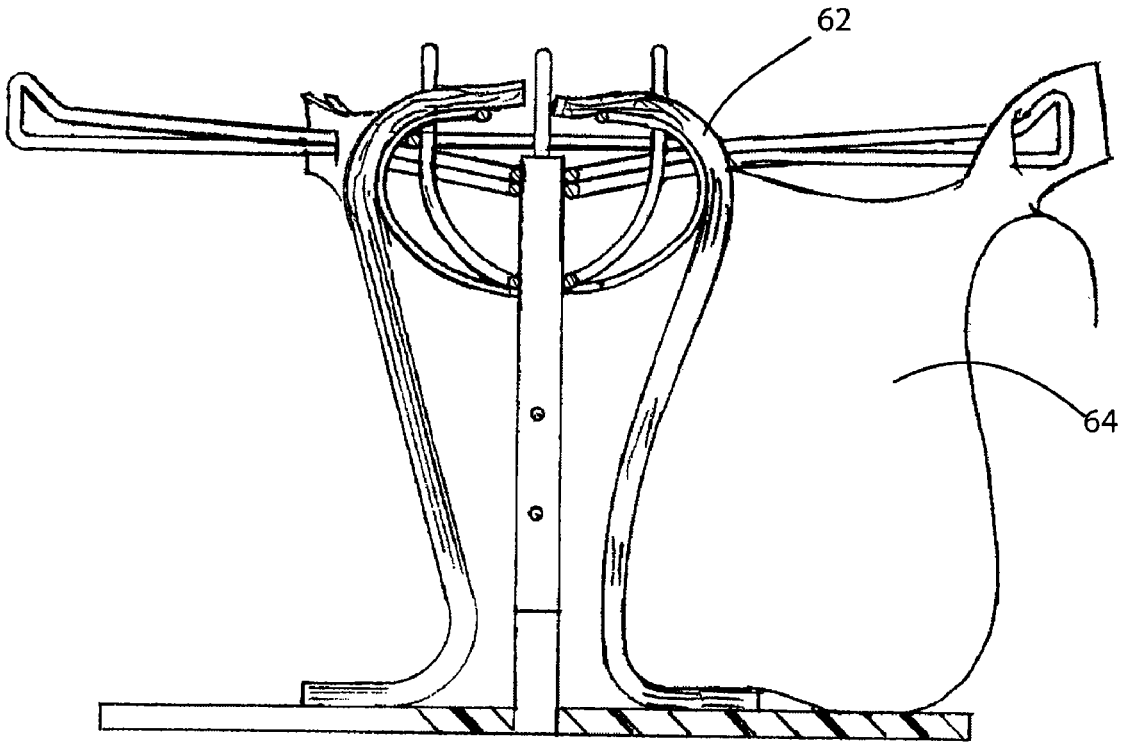
FIG. 8 is a side view of the multi-unit carousel rack with a bundle of T-shirt bags placed in each holder with the front leading bag open in one of the holders.

In use, the series of T-shirt bags may be placed such that tab 16 of the T-shirt bag (FIG. 1) is connected to, for example, two of projections 44 (FIG. 6) through tab hole 17. T-shirt bag handles 12 and 14 will be placed on the set of arms 38 through T-shirt handle holes 13 and 15. The T-shirt bag would be placed between the arms connected to adjacent horizontal extensions. In other words, as an example, handle 12 may be connected to arm 38*a* (FIG. 7) and handle 14 connected to arm 38*b*. Handles 12 and 14 from another set of bags may be connected between arms 38*c* and 38*d*, and between arms 38*e* and 38*f*. FIG. 8 shows a side view of the new compact tri-rack carousel with bundle of T-shirt bags 62 attached to projection 44 and open lead bag 64. In this embodiment, each rack has two projections 44, which may be used to hang a T-shirt bag.

The distance between two arms at the front and the middle of each rack is 12". The distance between projection 44 and an imaginary line which connects points D and G (FIG. 7) is still 8". The distance between projection 44 to the tip of each arm is about 9.75". The distance between C1 and C2 at the back of the rack is 4". The usable length of each arm 38 is 5.75". The circular board has an 11" radius (22" diameter). The center of this carousel has an unused equilateral triangle space and each side of the triangle has 4" length and its surface is about 6.93 square inches or 55.42 square inches less than the prior art cube multi-unit carousel rack.

The advantage of the compact tri-rack carousel is that all of the racks are located within an extended arm of the cashier, which is usually about 22" while the hand is closed. This means the cashier can load all of the three racks without turning the carousel or without moving or taking a step.

Figure 9:
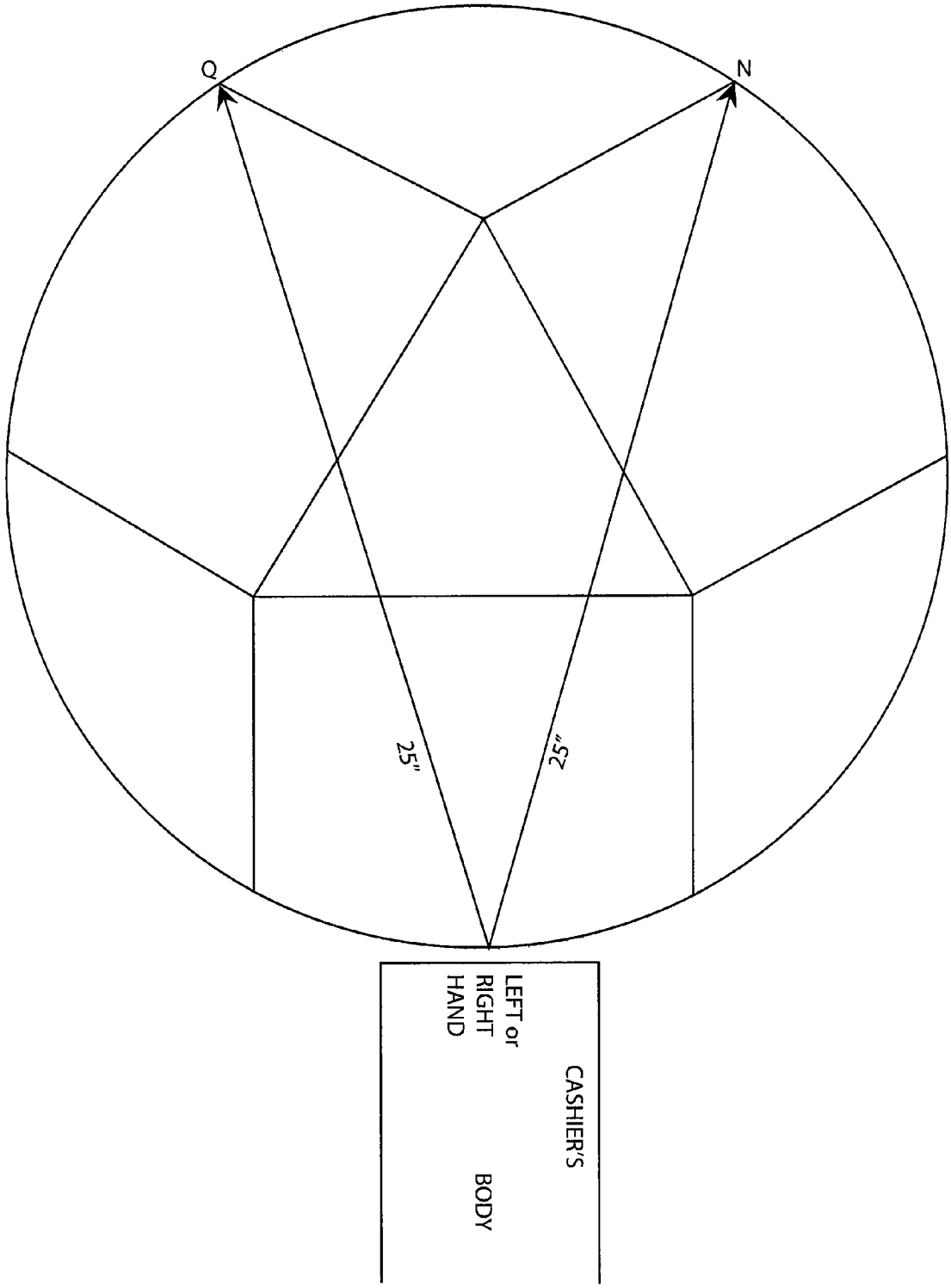
FIG. 9 (PRIOR ART)
FIG. 9 is a schematic top view of the table for a prior art multi-unit carousel rack that uses cube racks.

FIG. 9 shows the optimum position of the cashier in regard to the position of racks of the prior art cube carousel rack. In this position, the distance between the cashier and points N and Q, which are the furthest points of the racks or maximum distance, is 25". This distance is more than the average distance of an extended arm when the hand is closed.

Figure 10:
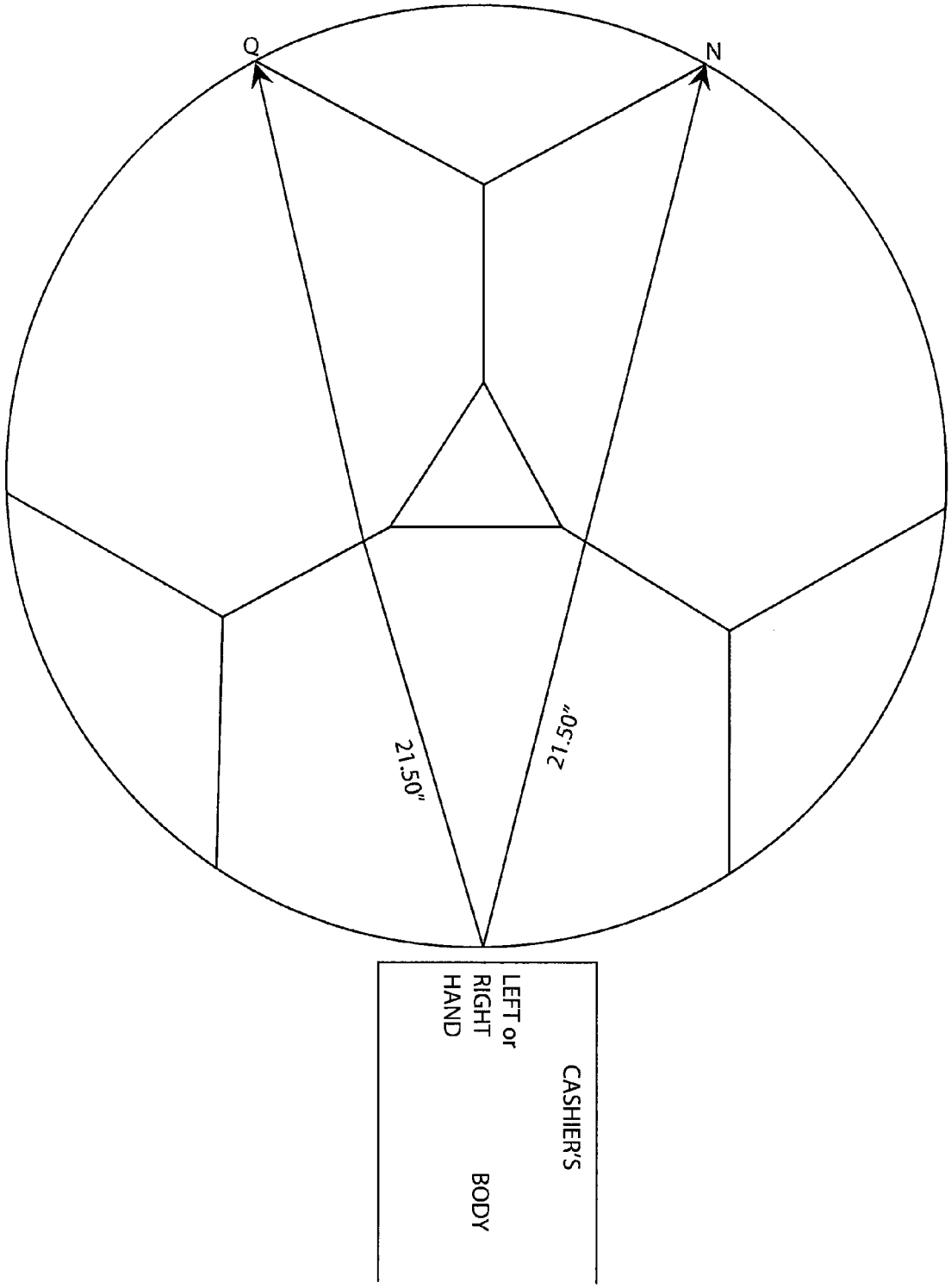
FIG. 10 is a schematic top view of the table for the multi-unit carousel rack of the present invention.

FIG. 10 shows the optimum position of the cashier in regard to the position of racks of the new compact tri-rack carousel. In this position, the distance between the cashier and points N and Q is 21.50". This is less than the distance of an extended arm when the hand is closed.

Figure 11:
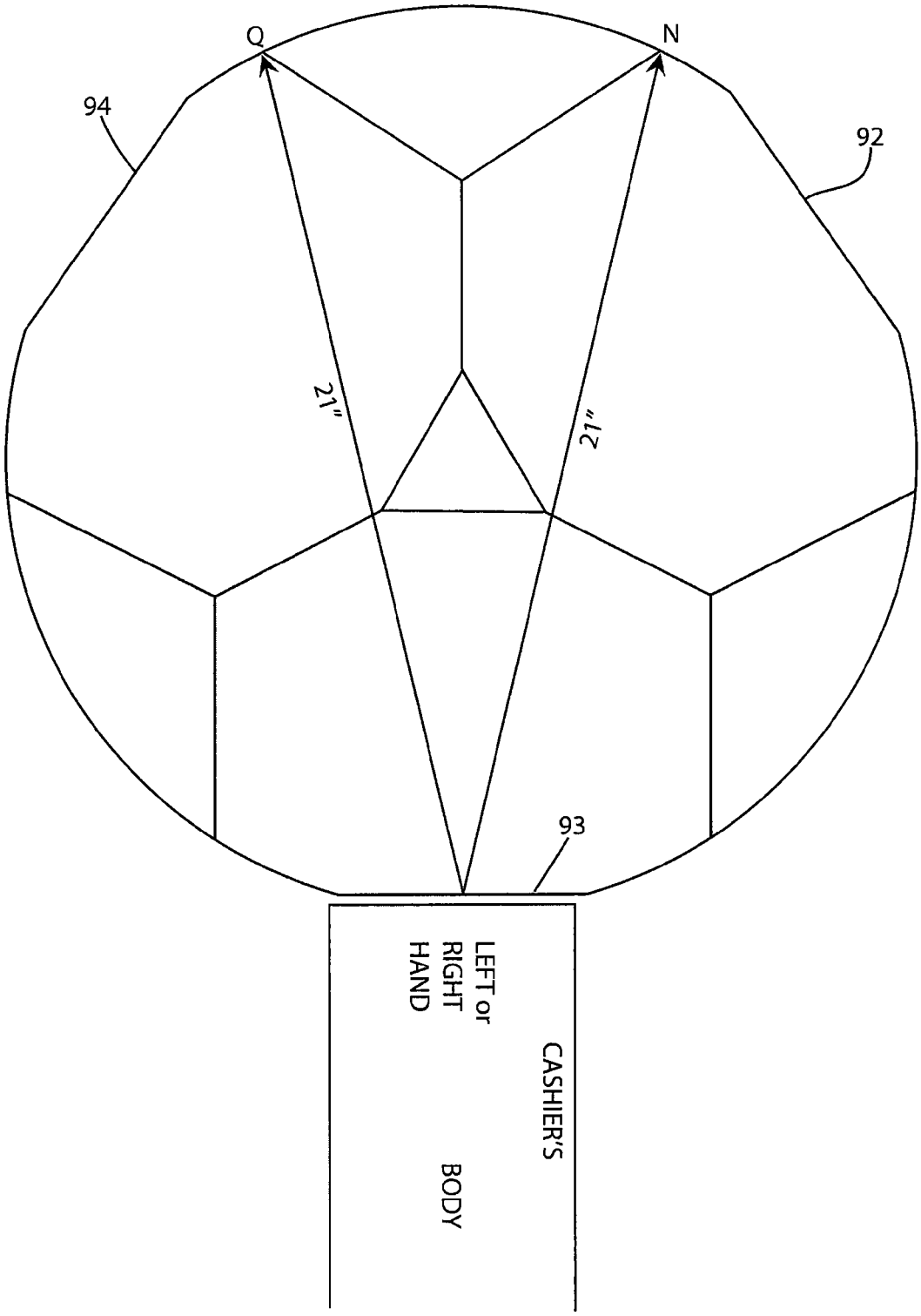
FIG. 11 is a schematic top view of an alternative embodiment for the table for the multi-unit carousel rack of the present invention.

In this new compact tri-rack carousel, since the cashier does not need to turn the base frequently, areas 92, 93 and 94 (FIG. 11) may be removed from the circular carousel base. The new base of the compact tri-rack carousel has a furthest distance between the cashier and any part of the three racks (points N and Q) of about 21". Since a cashier does not need to turn the carousel or walk one step, the cashier will be able to continuously scan and pack the items for checkout.

The following are the steps that a cashier may follow:

Action 1: Pick up an item from the incoming conveyer belt by using their right hand.

Action 2: Scan the item by using their right hand (sometimes both hands).

Action 3: Pass the item from their right hand to their left hand after scanning.

If the cashier is bagging the items using the prior art one rack unit, the following may happen afterwards:

Action 4: Their left hand may put the item inside the opened bag of the rack.

If the cashier bags the item by using a prior art cube rack carousel, the following may happen:

Action 4A—Their left hand may put the item inside the opened bag of the rack which is closest to the cashier, less than one arm distance which is 22", or Action 4B—Their left hand may put the item inside one of the other two bags which is more than 22" (or more than one arms distance) from the cashier, since the diameter of current tri-carousel racks are 26".

In the 4B scenario, the cashier may have to stop their continuous action (which is to pick up an item, scan the item and pass the item to their other hand) and with their left hand turn the carousel to the right or left to access the other two bags, or take a step to get closer to the other two bags, or bend their body over in an non-ergonomic move to access the other two bags. Turning the carousel rack, taking a step or bending over in a non-ergonomic motion creates extra actions. These extra actions significantly slow down the speed of the cashier by stopping the continuous action of the cashiers.

With the newly designed tri-rack carousel, actions 1 to 3 are the same as before. However, action 4 will be similar to action 4A of above scenarios. It means the left hand, by following its continuous action can drop the item in one of the three racks without necessitating the turning of the rack, or without needing to take any steps to the left or right, since all of the three racks are accessible to the left hand and all of the racks are less than 22" (that is, less than one arms distance) from the cashier.

Figure 12:
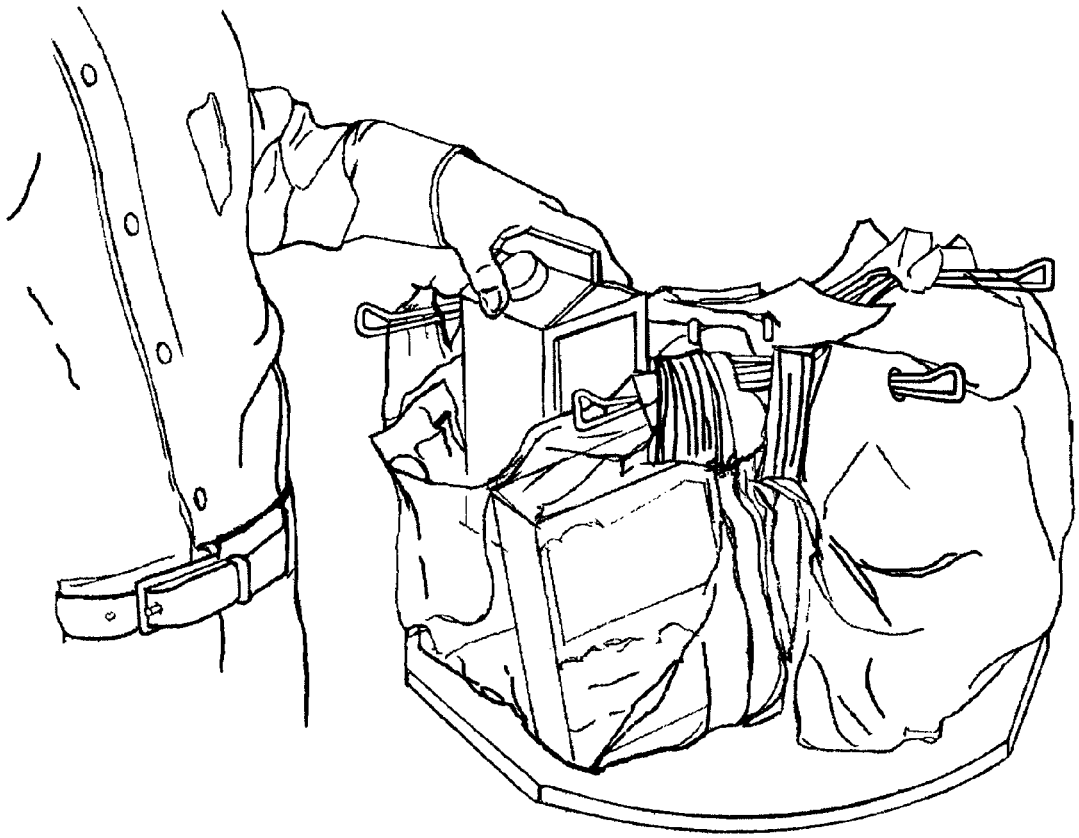
FIG. 12 is an example of a user loading a first bag with a grocery item.
Figure 13:
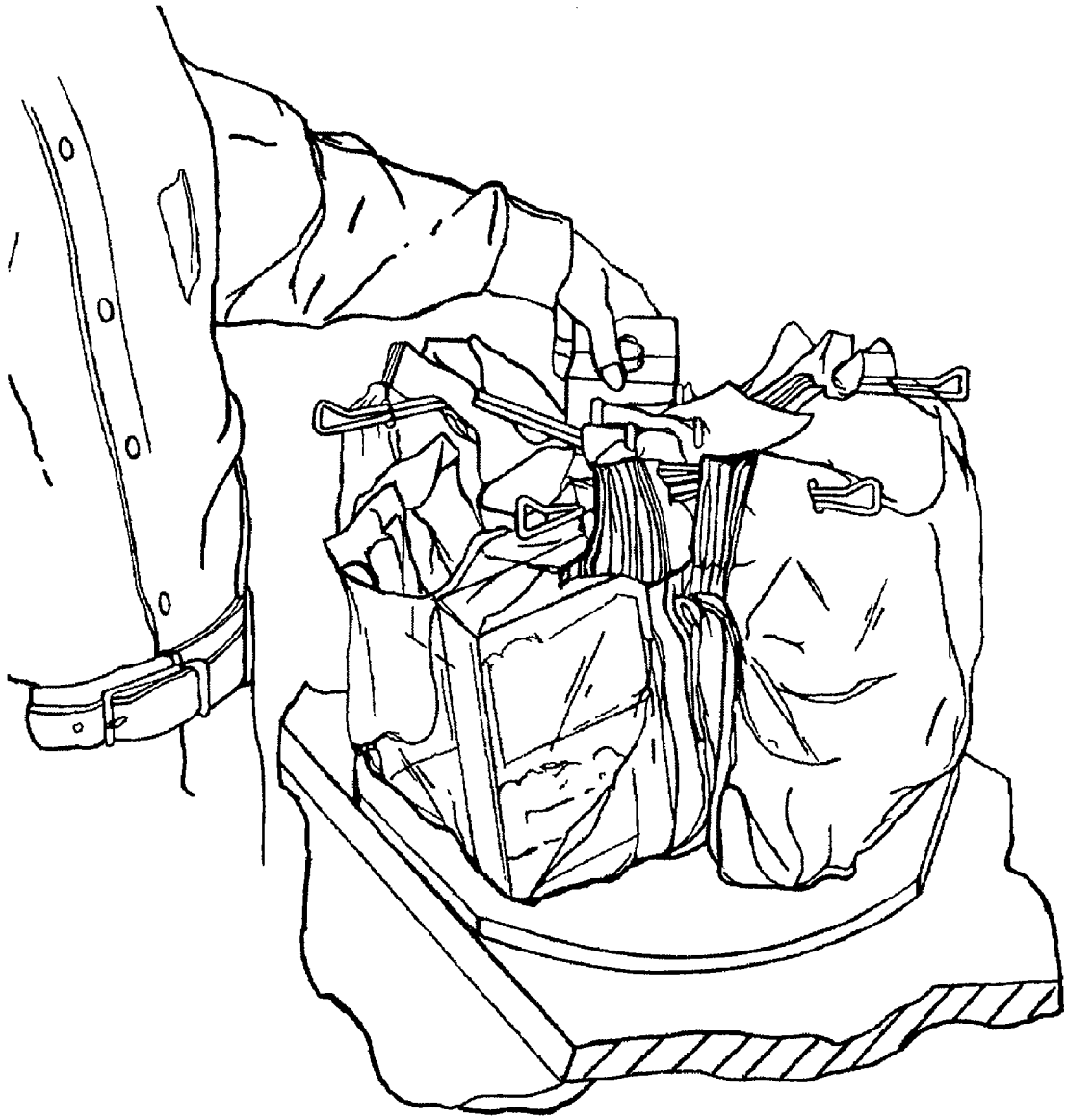
FIG. 13 is an example of a user loading a second bag with a grocery item.
Figure 14:
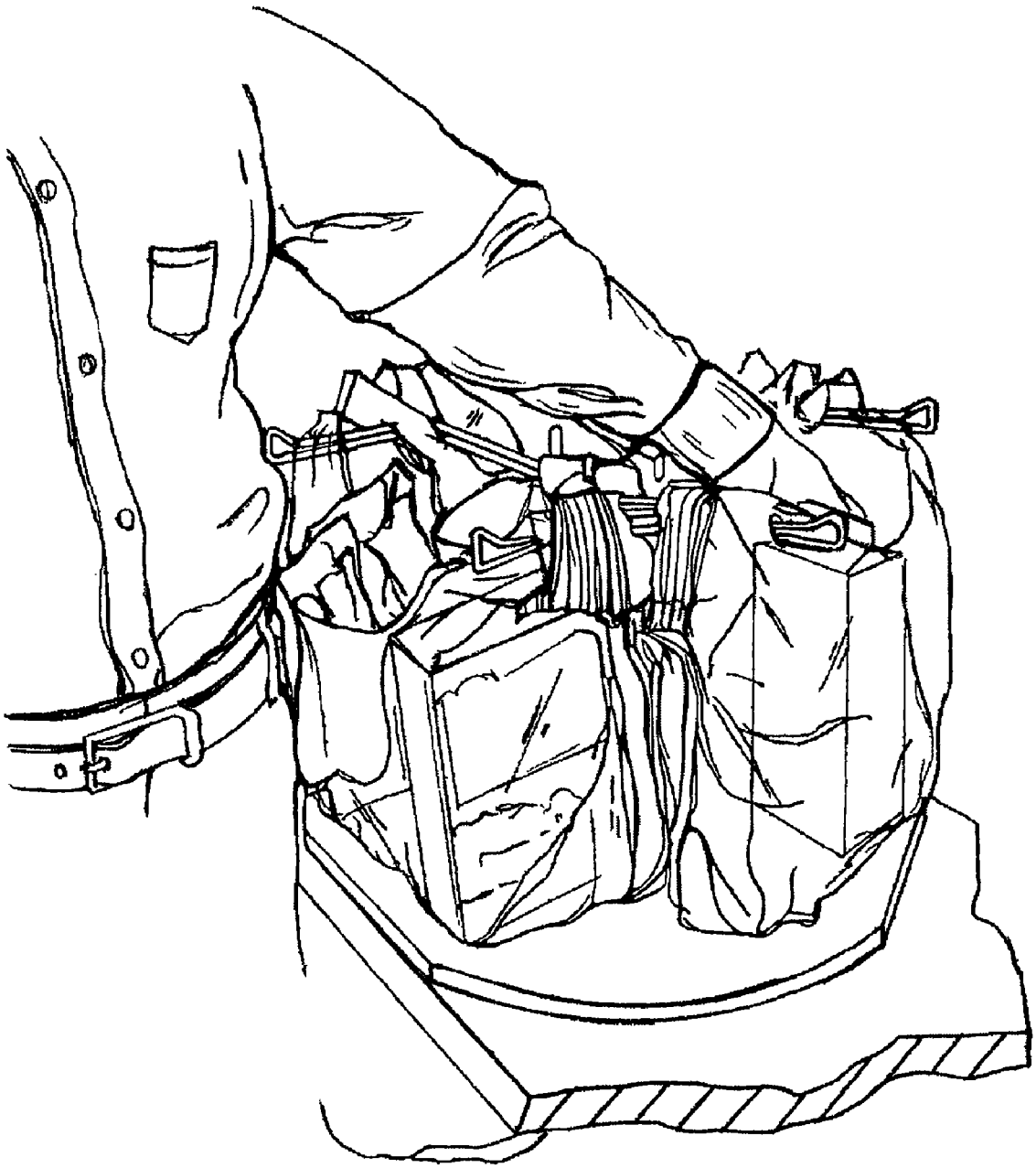
FIG. 14 is an example of a user loading a third bag with a grocery item.

FIGS. 12, 13, and 14 show respectively a user inserting items into each of the three respective bags in the newly designed compact tri-rack carousel.

While the disclosure shows a tri-rack carousel, which contains three bag racks, the concepts of the invention can extend to other numbers of racks such as, for example, four, five or more racks mounted on a carousel.

The invention claimed is:

1. A holder for a bundle of T-shirt bags comprising:

a base substantially defining a plane;

a vertical support having a longitudinal axis, a proximal end and a distal end, wherein the distal end is connected to the base and the longitudinal axis of the vertical support is substantially perpendicular to the plane of the base;

a first extension and a second extension coupled to the vertical support, with the first and second extensions being substantially perpendicular to the longitudinal axis of the vertical support and forming a first angle less than 180 degrees in the radial direction around the longitudinal axis of the vertical support; and first and second arms connected to the first extension and first and second arms connected to the second extension with each arm and extension connected at a second angle that is greater than 90 degrees, wherein the first and second arms of each pair of arms are substantially parallel to one another and the first arm is configured to receive a first handle of the bundled T-shirt bags and the second arm is configured to receive a second handle of the bundled T-shirt bags.

2. The holder of claim 1, further comprising:

a projection located adjacent the point where the first and second extensions are coupled to the vertical support and adapted to receive a tab of the bundle of T-shirt bags.

3. The holder of claim 1, further comprising:

two projections located adjacent the coupling of the first and second extensions to the vertical support and adapted to receive a tab of the bundle of T-shirt bags.

4. The holder of claim 1, wherein the first and second arms have proximal ends connected to the extension and a distal ends having a profile for impeding the handles of the T-shirt bags from prematurely disengaging the arms.

5. The holder of claim 1, wherein the base is rotatable.

6. The holder of claim 1, wherein the base is circular with a cutout located between the first and second arms.

7. The holder of claim 1, wherein the first angle is approximately 120 degrees.

8. The holder of claim 1, wherein the second angle is approximately 120 degrees.

9. The holder of claim 1, further comprising:

a third extension coupled to the vertical support that is substantially perpendicular to the longitudinal axis of the vertical support and forming the first angle with both the first extension and the second extension in the radial direction around the longitudinal axis of the vertical support; and the first, second and third extensions having a set of two arms each, with arms on adjacent extensions being parallel to one another.

10. Apparatus for supporting a multiplicity of plastic bags, comprising:

a horizontal base, at least three bag supporting racks mounted on said base, each rack including a rear extension member and two generally parallel arms for supporting multiple plastic bags, the arms of each rack extending from a rear extension member, the angle between each arm and its associated extension member being substantially greater than 90 degrees, with at least a portion of each extension member being contiguous with at least a portion of the extension member of each adjacent rack, and means for supporting the racks on said base.

11. Apparatus according to claim 10, wherein the base is rotatable.

12. Apparatus according to claim 10, wherein each extension includes a central portion which is not contiguous with any portion of any other extension member.

13. Apparatus according to claim 12, wherein said means for supporting comprises a vertical member attached to said central portions.

14. Apparatus according to claim 10, wherein said three bag supporting racks are mounted on said base and the angle between each arm and its associated extension member is approximately 120 degrees.

* * * * *